United States Patent [19]

Shaw

[11] Patent Number: 5,062,274

[45] Date of Patent: Nov. 5, 1991

[54] UNLOADING SYSTEM FOR TWO COMPRESSORS

[75] Inventor: David N. Shaw, Manlius, N.Y.

[73] Assignee: Carrier Corporation, Syracuse, N.Y.

[21] Appl. No.: 546,211

[22] Filed: Jun. 28, 1990

Related U.S. Application Data

[63] Continuation-in-part of Ser. No. 374,907, Jul. 3, 1989, Pat. No. 4,938,029.

[51] Int. Cl.[5] ..... F25B 41/04

[52] U.S. Cl. ..... 62/117; 62/196.2; 62/197; 62/228.5

[58] Field of Search ..... 62/117, 196.1, 196.2, 62/196.3, 197, 228.5, 510; 236/1 EA

[56] References Cited

U.S. PATENT DOCUMENTS

| | | | |
|---|---|---|---|
| 2,388,556 | 11/1945 | Lathrop | 62/197 |
| 3,495,418 | 2/1970 | Kapich | 62/228.5 X |
| 3,859,815 | 1/1975 | Kasahara | 62/197 |
| 4,324,105 | 4/1982 | Cann | 62/196.2 |
| 4,526,012 | 7/1985 | Chigira | 62/196.3 |
| 4,938,029 | 7/1990 | Shaw | 62/228.5 X |

*Primary Examiner*—Harry B. Tanner

[57] ABSTRACT

An economizer is connected to a fluid line connecting the booster compressor and high stage compressor of a refrigeration system at a point downstream of the bypass for unloading the booster compressor. The economizer flow controls the discharge temperature of the second stage and, in addition, coacts with the bypassing of the booster compressor such that all of the flow supplied to the high stage is at system suction pressure when the bypass is fully open. When the booster compressor is fully unloaded and the unloading valve is fully open, the booster compressor is shut off and bypass flow for unloading reverses direction to permit flow from the condenser to the second stage past the shut off booster compressor.

9 Claims, 1 Drawing Sheet

UNLOADING SYSTEM FOR TWO COMPRESSORS

The present invention is a continuation-in-part of application Ser. No. 374,907, U.S. Pat. No. 4,938,029 filed Jul. 3, 1989 and commonly assigned.

BACKGROUND OF THE INVENTION

The capacity of a two compressor or two-stage compressor system is a function of the volumetric efficiency, $V_e$, the change in enthalpy, $\Delta$ H, and the displacement efficiency, $D_e$. In a two compressor system the flow is serially through a booster compressor (low stage) and a high stage compressor. Unloading of this arrangement is typically achieved by regulating the booster compressor. In two-stage reciprocating compressor systems the cylinders are divided between the two stages with the first stage having, typically, twice as many cylinders as the second stage. Unloading of this arrangement can be achieved by gas bypass or suction cutoff of one or more cylinders of the first stage. In fact, the entire first stage can be unloaded so that the second stage is doing all of the pumping and is being supplied at the compressor suction pressure. Since the entire first stage discharge may be bypassed to suction, this arrangement also serves to negate the capacity increase associated with the use of a economizer. In U.S. Pat. application Ser. No. 374,907, means are employed in a two-stage compression system so as to both control the temperature of the second stage discharge and to unload the compressor. Unloading the compressor is through the use of a bypass which directs the first stage discharge of the compressor back to suction. When the bypass is fully open, the second stage inlet operates at system suction pressure and second stage displacement alone must now handle the vapor generated by both the system evaporator and the economizer. This effectively reduces the vapor generated by the system evaporator to a fraction of its full load amount thus accomplishing very effective unloading.

SUMMARY OF THE INVENTION

A two compressor system, made up of a booster compressor and a high stage compressor in series, is initially unloaded by bypassing the booster compressor back to suction. When the modulating bypass valve is fully open, the high stage compressor operates essentially at system suction pressure. If the high stage compressor is capable of supplying the system requirements, the continued operation of the booster pump serves no useful purpose. Upon satisfactory operation with the booster pump fully unloaded for an appropriate time, such as 15 minutes, the booster pump is shut off. The modulating valve which was fully open is maintained that way and there is a flow reversal therethrough since the bypass line now becomes the supply line to the high stage.

It is an object of this invention to provide a method and apparatus which provides a simple, efficient and reliable unloading of a two compressor system.

It is another object of this invention to provide an economizer operation in a two compressor system. These objects, and others as will become apparent hereinafter, are accomplished by the present invention.

Basically, the economizer is connected to the fluid line connecting the booster and high stage compressors at a point downstream of the bypass line for unloading the booster compressor. The economizer flow is also directed to control the discharge temperature of the high stage compressor and, in addition, coacts with the bypassing of the booster compressor such that all of the flow supplied to the high stage is essentially at system suction pressure when the bypass is fully open. If the bypass is fully open for a sufficient length of time, the booster compressor is shut off and the bypass becomes the suction line for the high stage compressor.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENTS

Figure 1:
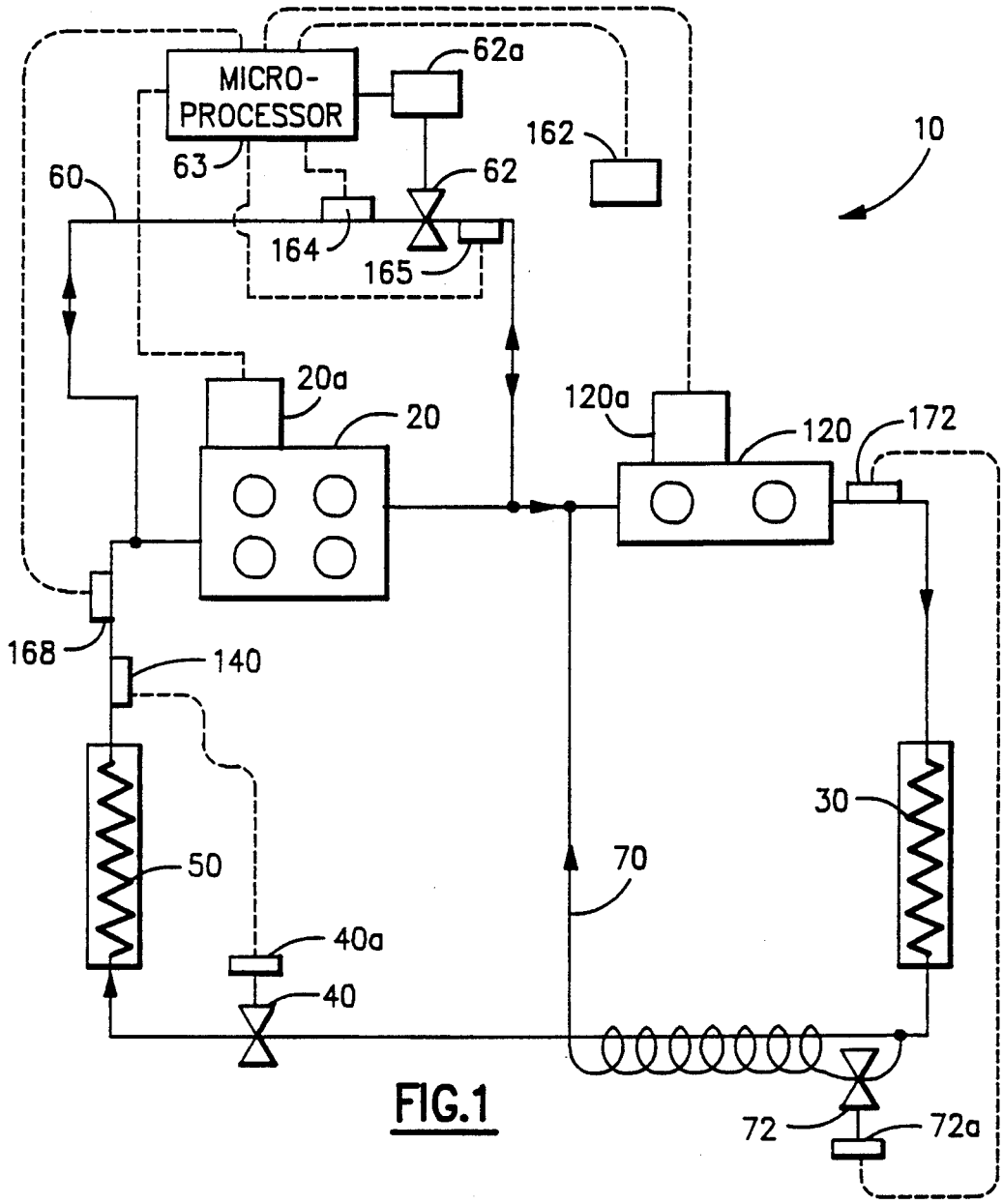
FIG. 1 is a schematic representation of a refrigeration system employing the present invention.

In FIG. 1, the numeral 10 generally designates a refrigeration system employing the present invention. Refrigeration system 10 includes booster compressor 20 driven by motor 20*a* and high stage compressor 120 driven by motor 120*a* with booster compressor 20 illustrated as a reciprocating compressor having four cylinders and high state compressor 120 illustrated as a reciprocating compressor having two cylinders. Refrigeration system 10 includes a fluid circuit serially including booster compressor 20, high stage compressor 120, condenser 30, thermal expansion valve 40, and evaporator 50. Line 60 contains modulating valve 62 and is connected between the suction and discharge sides of booster compressor 20. Valve 62 is operated through solenoid 62*a* by microprocessor 63 which is connected to temperature sensor 162 which is in the zone being cooled, pressure sensors 164 and 165 located upstream and downstream, respectively, of valve 62 (when compressor 20 is off) flow sensor 168 which is located downstream of evaporator 50 and upstream of bypass line 60, and motors 20*a* and 120*a*.

Economizer line 70 extends between a point intermediate condenser 30 and thermal expansion valve 40 and a point intermediate booster compressor 20 and high stage 120 but downstream of the intersection with line 60. Valve 72 is located in economizer line 70 and is operated through solenoid 72*a* responsive to temperature sensor 172 which is located at the outlet of high stage 120. Thermal expansion valve 40 is operated through solenoid 40*a* responsive to temperature sensor 140 which is located at the outlet of evaporator 50.

In operation at full load, valve 62 is closed and the entire output of booster compressor 20 is supplied to high stage compressor 120. The hot, high pressure refrigerant gas output of high stage 120 is supplied to condenser 30 where the refrigerant gas condenses to a liquid which is supplied to thermal expansion valve 40. Thermal expansion valve 40 is controlled responsive to the outlet temperature of evaporator 50 as sensed by temperature sensor 140 and causes a pressure drop and partial flashing of the liquid refrigerant passing through valve 40. The liquid refrigerant supplied to evaporator 50 evaporates and the gaseous refrigerant is supplied to booster compressor 20 to complete the cycle. Valve 72 is operated responsive to the outlet temperature of high stage 120 as sensed by temperature sensor 172 and controls the flow of liquid refrigerant through line 70 in order to maintain the desired outlet temperature of high stage compressor 120. Liquid refrigerant is expanded down to the interstage pressure in passing through valve 72 and in expanding causes cooling of the liquid refrigerant flowing to evaporator 50 with further cooling effect in the high stage 20.

As the load requirements sensed by sensor 162 fall, valve 62 is proportionally opened by microprocessor 63 to permit a bypassing of the output of booster compressor 20 via line 60 back to the suction side. At the extreme, valve 62 will be fully opened thereby completely unloading booster compressor 20 and placing the suction and discharge side of the booster compressor 20 at essentially the same pressure which is also the pressure in evaporator 50. As more of the output of booster compressor 20 is bypassed, the mass flow supplied to the high stage 120 decreases. Because high stage 120 is always working when refrigeration system 10 is operating, high stage 120 is drawing refrigerant into its suction side at all times. Thus, high stage 120 always draws at least a portion of the output of the operating booster compressor 20 which is necessary to maintain flow in evaporator 50 and, in addition, draws whatever flow is permitted by valve 72. As a result, the economizer flow through line 70 is always supplied to the high stage 120 rather than being able to bypass the booster compressor 20 when booster compressor 20 is operating. As the booster compressor 20 is unloaded, the interstage pressure and the mass flow to the high stage 120 decreases, but the resultant mass flow delivery to the system 10 from the high stage compressor 120 will drop faster than the interstage pressure due to the drop in volumetric efficiency in the high stage.

Figure 2:
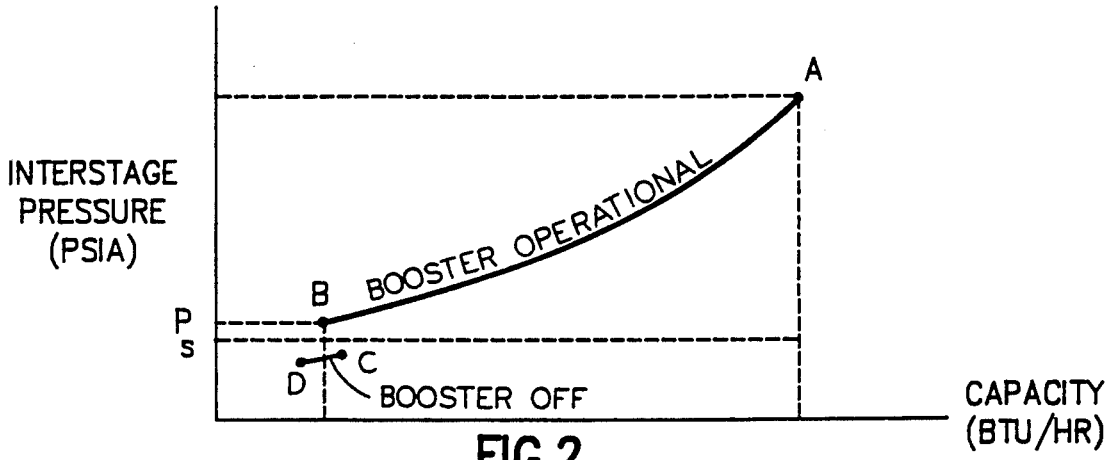
FIG. 2 is a graph showing relationship of capacity to interstage pressure.

Referring now to FIG. 2, the point A represents the conditions for R-22 where valve 62 is closed so that there is no bypassing and the interstage pressure and capacity of system 10 are at their maximums (e.g. 82 psia and 42,000 BTU/hr). Point B represents the fully bypassed condition where valve 62 is fully open and the interstage pressure is, nominally, 1 psi above $P_s$ the pressure upstream of booster compressor 20 which is the suction pressure of booster compressor 20 when it is operating. The 1 psi difference is due to the pressure drop through valve 62. The capacity of system 10 at point B is at its minimum (e.g. 18 psia and 6,000 BTU/hr). More specifically, point A represents the conditions on a hot day where the volumetric efficiency, $V_e$, is high because at full load both compressors are being utilized and therefore the pressure ratio across each is low, the change in enthalpy, $\Delta$ H, is high because of the use of an economizer and the economizer flow is directed to the trapped intermediate pressure, and the displacement efficiency, $D_e$, is high because all (four) of the booster compressor cylinders are actively pumping vapor generated only by the evaporator 50. Point B represents the conditions on a cold day where $V_e$ is low due to the high pressure ratio across the (two) high stage cylinders, $\Delta$ H is higher because the economizer flow is being dumped to a lower pressure, and $D_e$ is very low because only the (two) high stage cylinders are now pumping the evaporator generated flow as well as the economizer generated flow. As a result, the turn down ratio can be about 7 to 1.

When the system 10 is operating at point B of FIG. 2, the booster compressor 20 serves no useful function while constituting some power draw and reduces refrigerant density due to its inherent heating effect on the refrigerant. Therefore, under some conditions, it may be desirable to shut off booster compressor 20. Under the conditions under which motor 20*a* and, therefore, booster compressor 20 would be shut off and high stage compressor 120 left running, valve 62 would be fully open. So, if booster compressor 20 was shut off, line 60 would provide a bypass to booster compressor 20 although there would be a reversal of the direction of flow in line 60 and of the pressure drop across valve 62. Thus, under operating conditions under which only high stage 120 is actively working, booster compressor 20 can be shut off by microprocessor 63. As a result of the shutting off of booster compressor 20, system performance will be represented which will reduce any tendency to cycle. The boost in capacity is due to the increased density of the refrigerant since it is no longer heated by the booster compressor 20 and this effect is greater than the decrease in capacity due to the reduction in the pressure of the refrigerant supplied to high stage 120 as a result of the pressure drop through valve 62. Specifically the pressure at point C represents the pressure as a result of the drop from $P_s$ in passing through valve 62 when booster compressor 20 is shut off and is the pressure at the suction of high stage compressor 120. Further capacity reduction from point C would be along the curve C-D and would be achieved through evaporator pressure regulation, unloading high stage compressor 120, cycling high stage compressor 120, etc., as necessary to balance the load. If the high stage compressor 120 is made up of plural compressors, one or more may be shut off to achieve the desired loading.

A number of conditions taken singly or in combination may trigger the shutting off of booster compressor 20. First, if valve 62 is held fully open for an appropriate time such as fifteen minutes, high stage compressor 120 has demonstrated sufficient capacity and booster compressor 20 can be shut off and high stage compressor 120 will draw refrigerant from evaporator 50 through line 60, and fully open valve 62. Second, if only a nominal pressure differential, e.g. 1 psi, is sensed between pressure sensors 164 and 165 for an appropriate time, booster compressor 20 is fully unloaded and may be shut off by microprocessor 63 and high stage 120 will be supplied from evaporator 50 via line 60. Third, if the flow through evaporator 50 sensed by flow sensor 165 remains at, or below, a predetermined level for an appropriate time, booster compressor 20 may be shut off by microprocessor 63 and high stage 120 will be supplied from evaporator 50 via line 60. When only high stage 120 is operating and it is unable to meet the demand sensed by temperature sensor 162, microprocessor 63 causes motor 20*a* to start and drive booster compressor 20. Valve 62 will be initially fully open but the starting of booster compressor 20 will cause a reversal in flow in line 60 so as to unload rather than bypass booster compressor 20. The slight increase in capacity described above will be lost and this coupled with the increased demand sensed by sensor 162 will result in valve 62 being modulated under the control of microprocessor 63 in order to match the load.

Although the present invention has been specifically described in terms of a reciprocating compressor, it is equally applicable to any two-stage compression arrangement. Also, although the economizer flow is supplied downstream of the bypass flow, it could be supplied upstream of the bypass flow if the cooling effects were desired. Further, valve 62 may be controlled responsive to other conditions or may be overridden as during startup. Other changes will occur to those skilled in the art. It is therefore intended that the scope of the present invention is to be limited only by the scope of the appended claims.

What is claimed is:

1. An unloading system for a refrigeration system comprising:

a first closed fluid loop serially including a first stage compressor means, a second stage compressor means, a condenser means, expansion means and evaporator means;

a second fluid loop defining bypass means and fluidly connected to said first loop between a first end located intermediate said first and second stages and a second end located intermediate said evaporator means and said first stage;

first valve means located in said second loop for unloading said first stage back to said second end of said second loop when said first valve means is open and said first stage compressor means is running and for bypassing said first stage from said second end to said first end of said second fluid loop when said first valve means is opened and said first compressor means is shut off;

a third fluid loop defining an economizer means and fluidly connected to said first loop between a first end located intermediate said condenser means and said expansion means and a second end located intermediate said first and second stages;

second valve means in said third loop for providing an economizer flow;

whereby when said first valve means is fully open said second stage alone must handle refrigerant vapor generated by both said evaporator means and said economizer means thereby unloading said refrigeration system.

2. The unloading system of claim 1 wherein said first end of said second loop is upstream of said second end of said third loop.

3. The unloading system of claim 1 wherein said first valve means is controlled responsive to the temperature in a zone.

4. The unloading system of claim 1 wherein said second valve means is actuated responsive to the temperature of refrigerant discharged from said compressor means.

5. The unloading system of claim 1 wherein said first valve means is controlled by microprocessor means.

6. The unloading system of claim 5 wherein said microprocessor means starts and stops said first stage compressor means responsive to said first stage compressor means being unloaded.

7. A method for unloading a refrigeration system including a closed fluid loop serially including a first stage compressor means, a second stage compressor means, a condenser means, an expansion means and evaporator means comprising the steps of:

operating the compressor means to compress refrigerant gas which is then circulated through the fluid loop;

diverting liquid refrigerant from a point intermediate the condenser means and the expansion means and passing the diverted liquid refrigerant through a valve means to cause flashing and supplying the refrigerant passing through the valve means to the fluid loop at a point intermediate the first and second stages whereby an economizer circuit is established;

diverting the output of the first stage compressor means to a point intermediate the evaporator means and the first stage compressor means when the first stage compressor means is running to unload the first stage compressor means whereby when the first stage compressor means is fully unloaded the interstage pressure is essentially that of the evaporator means;

shutting off said first stage compressor means when said first stage compressor means is fully unloaded to bypass said first stage compressor means.

8. The method of claim 7 wherein the valve means is operated responsive to the temperature of the refrigerant leaving the second stage.

9. The method of claim 7 wherein shutting off said first stage compressor means avoids the inherent heating of refrigerant gas in passing through said first stage compressor means and thereby provides a slight increase in capacity of said second stage compressor means as well as eliminating the power draw of said first stage compressor means.

* * * * *